US011136854B2

(12) United States Patent
Kellner et al.

(10) Patent No.: US 11,136,854 B2
(45) Date of Patent: Oct. 5, 2021

(54) DOWNHOLE TOOL WITH SEALING RING

(71) Applicant: INNOVEX DOWNHOLE SOLUTIONS, INC., Houston, TX (US)

(72) Inventors: Justin Kellner, Adkins, TX (US); Carl Martin, Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 0 days.

(21) Appl. No.: 16/695,316

(22) Filed: Nov. 26, 2019

(65) Prior Publication Data

US 2020/0173246 A1 Jun. 4, 2020

Related U.S. Application Data

(60) Provisional application No. 62/773,507, filed on Nov. 30, 2018.

(51) Int. Cl.

| | |
|---|---|
| ***E21B 33/129*** | (2006.01) |
| ***E21B 33/128*** | (2006.01) |
| ***E21B 23/06*** | (2006.01) |

(52) U.S. Cl.

CPC ..... *E21B 33/129* (2013.01); *E21B 23/06* (2013.01); *E21B 33/128* (2013.01)

(58) Field of Classification Search

CPC ..... E21B 33/129; E21B 23/06; E21B 33/128

See application file for complete search history.

(56) References Cited

U.S. PATENT DOCUMENTS

| | | | | |
|---|---|---|---|---|
| 5,064,164 | A * | 11/1991 | Le | E21B 33/062 251/1.1 |
| 2010/0038072 | A1* | 2/2010 | Akselberg | E21B 33/1212 166/118 |
| 2014/0131054 | A1* | 5/2014 | Raynal | E21B 33/04 166/387 |
| 2016/0305215 | A1* | 10/2016 | Harris | E21B 33/1291 |
| 2016/0376869 | A1* | 12/2016 | Rochen | E21B 29/02 166/135 |

* cited by examiner

*Primary Examiner* — Dany E Akakpo
(74) *Attorney, Agent, or Firm* — MH2 Technology Law Group LLP

(57) ABSTRACT

A downhole tool includes a cone having a tapered outer surface, a slip assembly positioned at least partially around the tapered outer surface of the cone, and a sealing ring positioned at least partially around the tapered outer surface of the cone. The slip assembly directly engages the sealing ring, such that the slip assembly is configured to transmit a setting force directly onto the sealing ring, which moves the sealing ring on the tapered outer surface of the cone and expands the sealing ring radially outward.

17 Claims, 5 Drawing Sheets

DOWNHOLE TOOL WITH SEALING RING

CROSS-REFERENCE TO RELATED APPLICATIONS

This application claims priority to U.S. Provisional patent application having Ser. No. 62/773,507, which was filed on Nov. 30, 2018, and is incorporated herein by reference in its entirety.

BACKGROUND

Packers, bridge plugs, frac plugs, and other downhole tools may be deployed into a wellbore and set in place, e.g., to isolate two zones from one another in the wellbore. Generally, such setting is accomplished using a system of slips and seals received around a mandrel. A setting tool is used to axially compress the slips and sealing elements, and thereby radially expand them. The slips, which often have teeth, grit, buttons, or other marking structures, ride up the inclined surface of a cone during such compression, and are forced outwards into engagement with a surrounding tubular (e.g., a casing or the wellbore wall itself). This causes the slips to bite into the surrounding tubular, thereby holding the downhole tool in place. The seal is simultaneously expanded by such axial compression into engagement with the surrounding tubular, so as to isolate fluid communication axially across the tool.

The seals are typically elastomeric, and have a tendency to extrude during setting and/or when a large pressure differential across the seals is present, such as during hydraulic fracturing. In particular, the seals may extrude through a gap between circumferentially-adjacent slips, which forms when the slips are expanded radially outwards. To address this tendency, backup members are sometimes positioned axially between the slips and the seals to block these gaps and prevent extrusion. While such back-up rings are implemented with success in the field, they represent additional components and introduce failure points in the design. Accordingly, there is a need for downhole tools that avoid the drawbacks associated with rubber sealing elements.

SUMMARY

A downhole tool is disclosed. The downhole tool includes a cone having a tapered outer surface, a slip assembly positioned at least partially around the tapered outer surface of the cone, and a sealing ring positioned at least partially around the tapered outer surface of the cone. The slip assembly directly engages the sealing ring, such that the slip assembly is configured to transmit a setting force directly onto the sealing ring, which moves the sealing ring on the tapered outer surface of the cone and expands the sealing ring radially outward.

A method of plugging a wellbore is disclosed. The method includes deploying a downhole tool into a surrounding tubular of the wellbore, the downhole tool being in a run-in configuration. The downhole tool includes a mandrel, a cone having a tapered outer surface, the cone being received around the mandrel, a slip assembly received around the mandrel and positioned at least partially around the tapered outer surface of the cone, and a sealing ring positioned at least partially around the tapered outer surface. The slip assembly directly engages the sealing ring. The method also includes actuating the downhole tool from the run-in configuration into a set configuration. Actuating the downhole tool includes pulling the mandrel in an uphole direction, and pushing the cone in a downhole direction. Pulling the mandrel and pushing the cone causes the slip assembly to move the sealing ring along the tapered outer surface, thereby expanding the sealing ring radially outward and into engagement with the surrounding tubular.

A downhole tool is disclosed. The downhole tool includes a mandrel, a cone having a tapered outer surface and received around the mandrel, a mule shoe coupled to the mandrel, a slips assembly positioned at least partially between the mule shoe and the cone, and a sealing ring positioned at least partially around the tapered outer surface of the cone and made of metal. An axial surface of the sealing ring is in direct engagement with an axial surface of the slips assembly, such that, pulling the mandrel and pushing the cone causes the mule shoe to move the slips assembly toward the sealing ring, which causes the sealing ring to move along the tapered outer surface of the cone and expand radially outward into engagement with a surrounding tubular.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
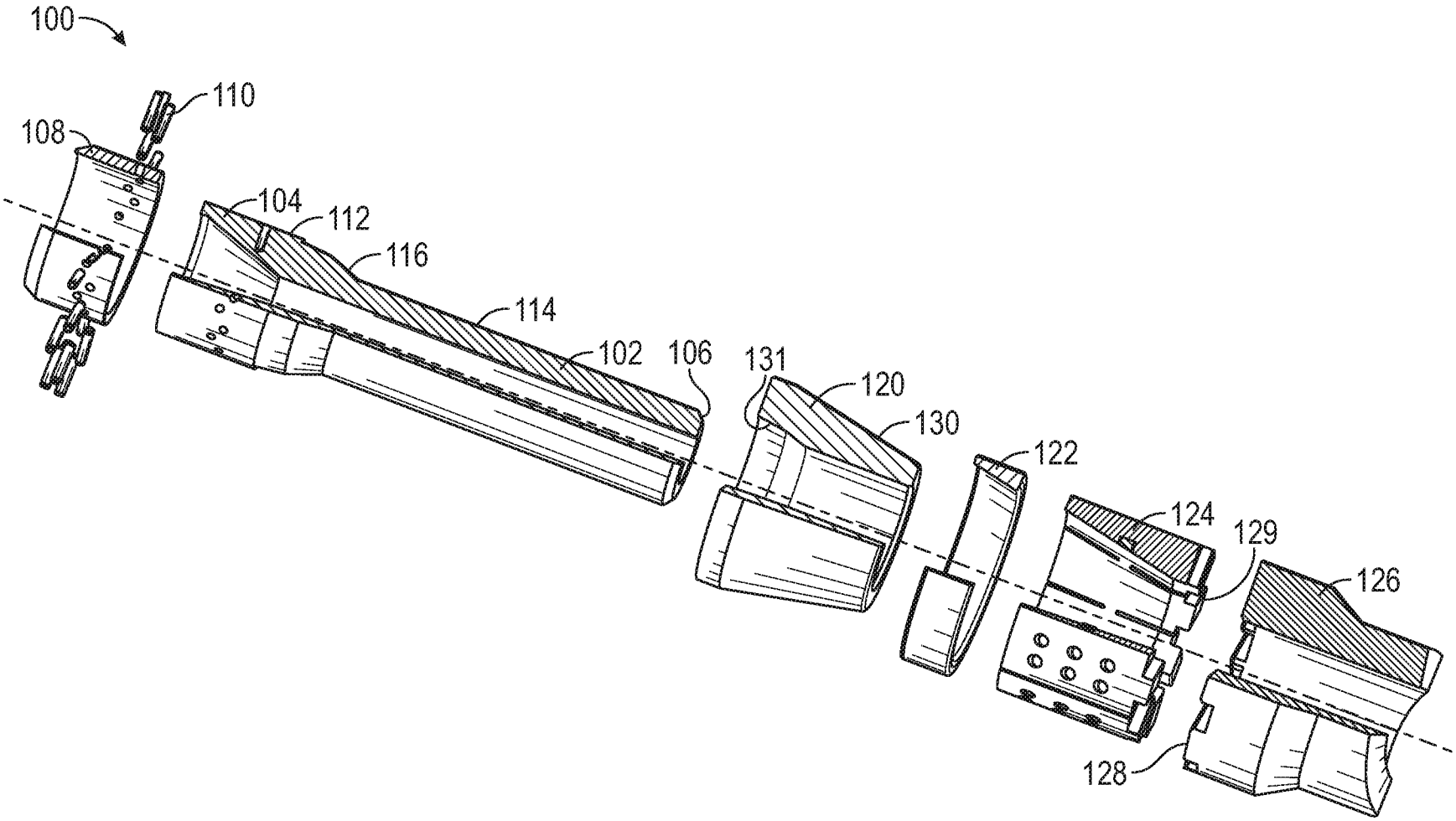
FIG. 1 illustrates an exploded, quarter-sectional view of a downhole tool, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In general, embodiments of the present disclosure may provide a downhole tool, such as a plug, that has a sealing ring. The sealing ring may be made from a material that resists extruding past the slips assembly, e.g., in contrast to elastomeric (rubber) sealing elements. The sealing ring may be positioned around a cone, and between the cone and a slip assembly of the tool. When setting the tool, the sealing ring may be expanded radially outward into engagement with a surrounding tubular. Such engagement may result in sealing the tool in the surrounding tubular, and also may apply a gripping force onto the surrounding tubular, which tends to keep the downhole tool in place relative to the surrounding tubular. The slips of the downhole tool may bear directly against the sealing ring during setting, causing the sealing ring to move axially along the cone, which results in the aforementioned expansion of the sealing ring.

Turning now to the specific, illustrated embodiments, FIG. 1 illustrates an exploded, quarter-sectional view of a downhole tool 100, according to an embodiment. The downhole tool 100 may be a packer, a bridge plug, a frac plug, or the like, without limitation. As shown, the tool 100 may generally include an inner mandrel 102 having an upper end 104 and a lower end 106. Optionally, a setting ring 108 may be attached to the upper end 104 of the mandrel 102, e.g., using shear pins 110. Additional details related to the setting ring 108 are provided in U.S. Provisional Patent Application Ser. No. 62/773,368, which is incorporated herein by reference, to the extent not inconsistent with the present disclosure. Various other ways to set a downhole tool by pulling upward on a mandrel, and accordingly, various other mandrel designs, are known, and in other embodiments, other types of setting arrangements/tools may be employed to this end.

The mandrel 102 may define an enlarged section 112 extending downward from the upper end 104 thereof. The mandrel 102 may also define a main section 114, which is radially smaller than the enlarged section 112. A shoulder 116 is defined at the transition between the main section 114 and the enlarged section 114. The shoulder 116 may be square or tapered. It will be appreciated that the mandrel 102 need not be a single, unitary piece, but may be two or more pieces that are coupled together.

The tool 100 may further include cone 120, a sealing ring 122, a slip assembly 124, and a mule shoe 126. Each of the cone 120, sealing ring 122, slip assembly 124, and mule shoe 126 may be received at least partially around main section 114 of the mandrel 102. The cone 120, sealing ring 122, and slip assembly 124 may be slidable on the mandrel 102, and the mule shoe 126 may be coupled (e.g., fixed) to the mandrel 102. For example, the mule shoe 126 may be threaded onto the lower end 106 of the mandrel 102. The mule shoe 126 may include upwardly-extending castellations 128, which may mesh with downwardly-extending castellations 129 of the slip assembly 124, thereby facilitating even load transmission therebetween.

The cone 120 may have a tapered outer surface 130, which extends radially outward as proceeding toward the upper end 104 of the mandrel 102. The cone 120 may also have a tapered inner surface section 131, e.g., extending to the upper end thereof, which extends radially outward as proceeding toward the upper end 104 of the mandrel 102. The tapered inner surface section 131 may extend at an angle of from about 1 degree, about 2 degrees, or about 3 degrees to about 7 degrees, about 8 degrees, or about 9 degrees. The shoulder 116 may define the same or a similar angle. Thus, the tapered inner surface section 131 and the shoulder 116 may engage along this angle. The engagement between the tapered inner surface section 131 of the cone 120 and the shoulder 116 of the mandrel 102 may prevent or at least resist the cone 120 from moving upward along the mandrel 102 during or after setting the tool 100.

Figure 2A:
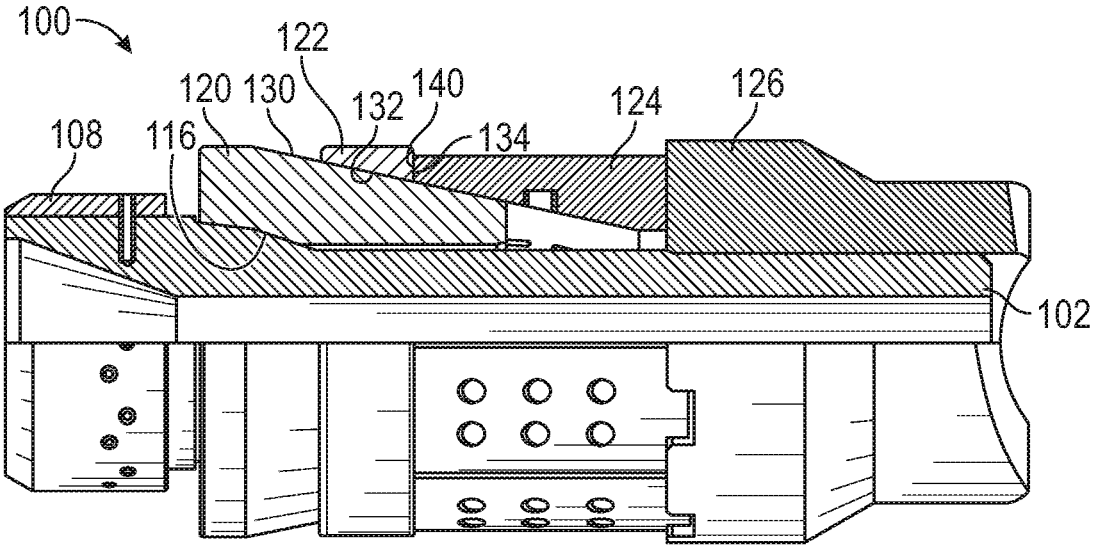
FIG. 2A illustrates a side, half-sectional view of the downhole tool in a run-in configuration, according to an embodiment.

Referring now additionally to FIG. 2A, there is shown a half-sectional, side view of the tool 100 in a run-in configuration, according to an embodiment. As is visible in FIG. 2A, the sealing ring 122 may be positioned around the tapered outer surface 130 of the cone 120. Specifically, the sealing ring 122 may have a tapered inner surface 132, which may be configured to slide along the tapered outer surface 130 of the cone 120.

The sealing ring 122 may be made from a metal or a composite (e.g., carbon-fiber reinforced material), e.g., rather than an elastomer. As such, in normal operating conditions, the sealing ring 122 may not extrude as a rubber sealing element might upon setting. Further, the sealing ring 122 may resist deforming, at least initially, which may prevent early setting of the tool 100, e.g., during run-in, prior to the tool 100 arriving at the desired depth in the wellbore. In a specific example, the sealing ring 122 may be made from a metal. For example, the metal may be magnesium, which may be dissolvable in the wellbore. In other embodiments, the sealing ring 122 may be made from other materials.

Further, at least a portion of the slip assembly 124 may be positioned around the tapered outer surface 130 of the cone 120. An upper axial end 140 of the slip assembly 124 may engage a lower axial end 134 of the sealing ring 122. In a specific embodiment, the upper axial end 140 may contact the lower axial end 134 with nothing in between, i.e., "directly engage" the lower axial end 134.

In the run-in configuration, the sealing ring 122 may have a first average thickness, in a radial direction. As shown, this radial thickness, combined with the relative positioning of the sealing ring 122 farther up on the cone 120 than the slip assembly 124, may result in the sealing ring 122 extending farther radially outward than the slip assembly 124.

Figure 2B:
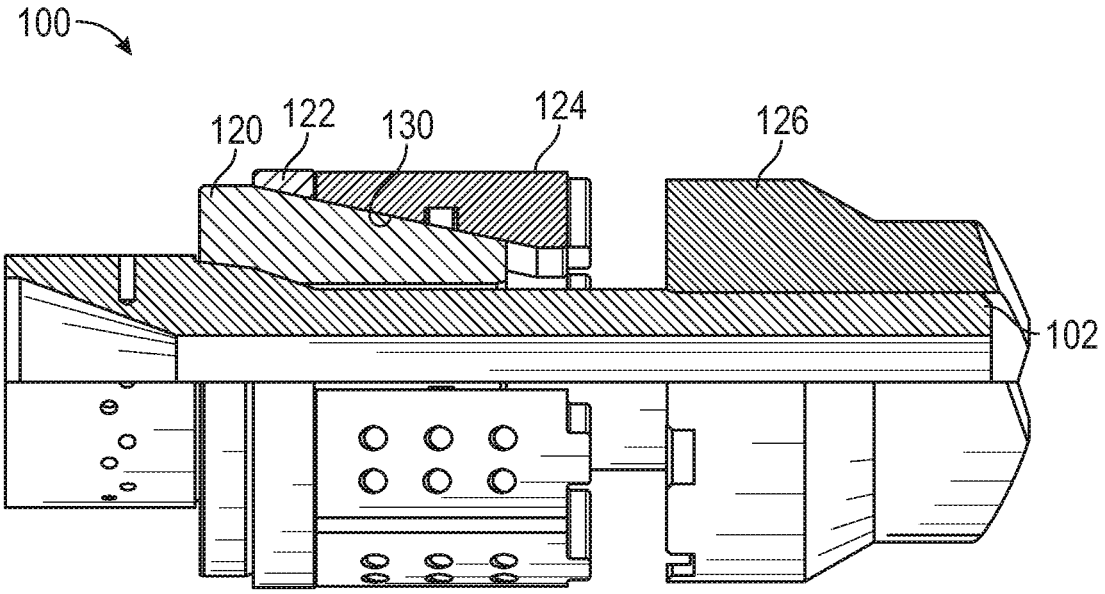
FIG. 2B illustrates a side, half-sectional view of the downhole tool in a set configuration, according to an embodiment.

When the tool 100 is deployed to a desired position within the wellbore, the tool 100 may be set in place. FIG. 2B illustrates a side, half-sectional view of the tool 100 in a set configuration, according to an embodiment.

To set the tool 100 (i.e., actuate the tool 100 from the run-in configuration of FIG. 2A to the set configuration of FIG. 2B), the mandrel 102 may be pulled in an uphole direction (to the left in the Figure), while a sleeve or another setting implement pushes in a downhole direction on the cone 120. Specifically, in this view, the tool 100 has been set, and, once set, the mule shoe 126 and the mandrel 102 have moved back to the right (downhole). It will be appreciated that the sleeve of the setting tool need not bear directly on the cone 120 during setting. For example, in some embodiments, a collar may be positioned above the cone 120, such that the setting sleeve applies force on the collar, which transmits the force to the cone 120. In other embodiments, a lock-ring housing or other ratcheting device may also or instead be positioned on the uphold side of the cone 120, and may similarly transmit forces to the cone 120.

By this combination of pushing and pulling, the mule shoe 126 is moved upward, while the cone 120 remains stationary or is moved downwards. As a consequence, the mule shoe 126 pushes the slip assembly 124 axially along the tapered outer surface 130 of the cone 120. This may expand, and in some embodiments, break the slip assembly 124 apart, such that the individual slips of the slip assembly 124 bite into the surrounding tubular (e.g., casing, liner, wellbore wall, etc.).

As this is occurring, the slip assembly 124, being pushed by the mule shoe 126, in turn pushes the sealing ring 122 up along the tapered outer surface 130 of the cone 120. This causes the annular sealing ring 122 to expand, e.g., by reducing in thickness. Eventually, the annular sealing ring 122 is pressed into engagement with the surrounding tubular, providing a metal-to-metal or composite-to-metal seal therewith. Further, because the annular sealing ring 122 is entrained between the tapered outer surface 130 of the cone 120, the surrounding tubular, and the slip assembly 124 (as the annular sealing ring 122 may resist extruding between the slips of the slip assembly 124, unlike a rubber sealing element), the sealing ring 122 not only seals with the surrounding tubular, but may form a press-fit therewith, thereby providing an additional gripping force for the tool 100, in addition to that provided by the slip assembly 124. Moreover, back-up rings or other elements meant to prevent failure of the sealing element may be omitted, as the sealing ring 122 itself may have sufficient strength to resist undesired yielding failure. Similarly, a rubber sealing element may also be omitted.

Figure 3A:
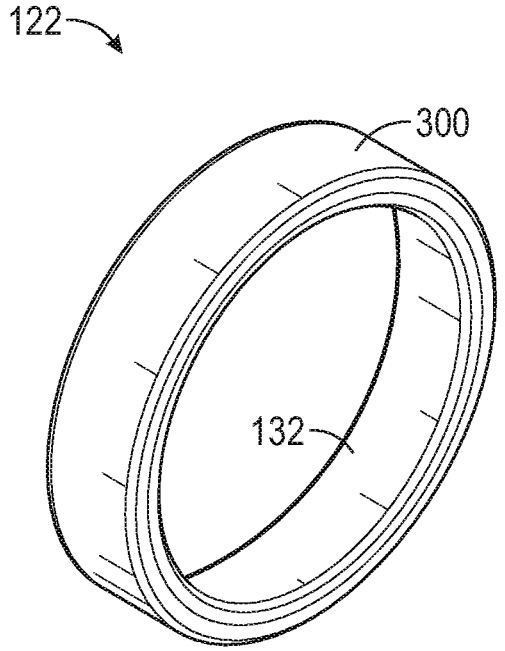
FIGS. 3A and 3B illustrate a perspective view and a side view, respectively, of an embodiment of a seal ring of the downhole tool, according to an embodiment.
Figure 3B:
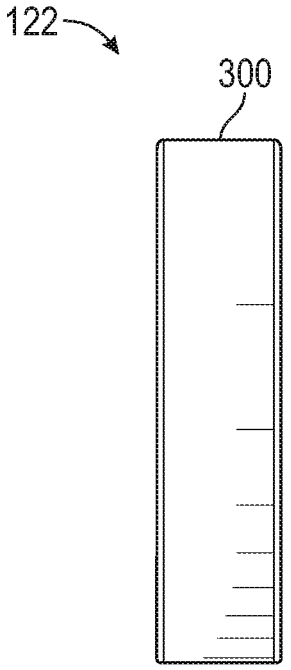

The setting ring 122 illustrated in FIGS. 1-2B is shown in greater detail in FIGS. 3A and 3B. As shown, the setting ring 122 is generally solid and wedge-shaped in cross-section, having the aforementioned tapered inner surface 132, and an outer surface 300 having a generally constant diameter.

Figure 4A:
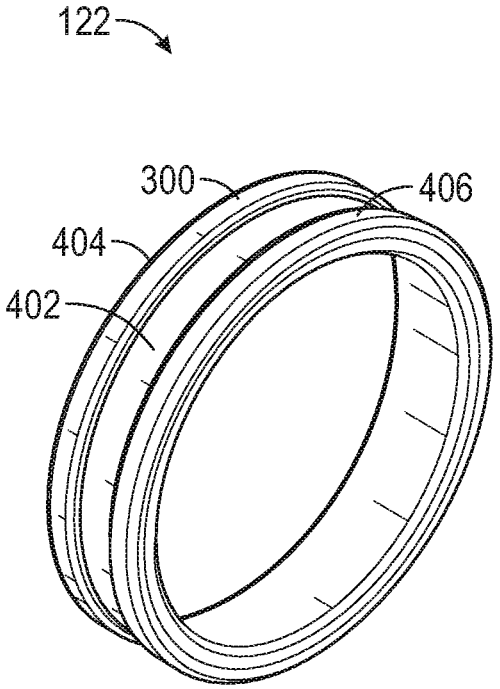
FIGS. 4A and 4B illustrate a perspective view and a side view, respectively, of another embodiment of the seal ring.
Figure 4B:
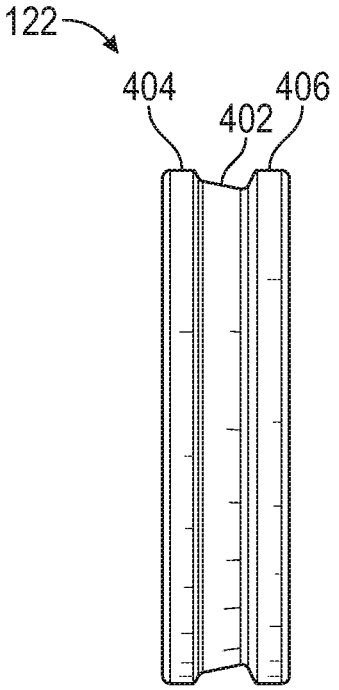

FIGS. 4A and 4B illustrate a perspective view and a side view, respectively, of another embodiment of the sealing ring 122. As shown, the outer surface 300 thereof may define a recessed center section 402 axially between two peaks 404, 406. Providing such a recessed center section 402 may reduce the force required to expand the sealing ring 122 during setting, e.g., by driving the sealing ring 122 up the tapered outer surface 130 of the cone 120, as mentioned above. Furthermore, as the sealing ring 122 is pressed against the surrounding tubular, the cross-section of the sealing ring 122 may change as the peaks 404, 406 deform and are reduced and the center section 402 increases in diameter to meet the surrounding tubular, thereby providing increased surface area contact with the surrounding tubular. It will be appreciated that multiple such recessed sections, and three or more peaks, may be provided, without departing from the disclosure.

Figure 5A:
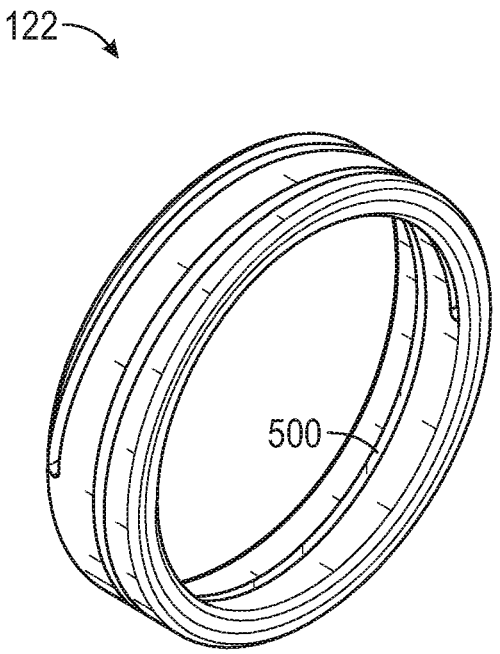
FIGS. 5A and 5B illustrate a perspective view and a side view, respectively, of another embodiment of the seal ring.
Figure 5B:
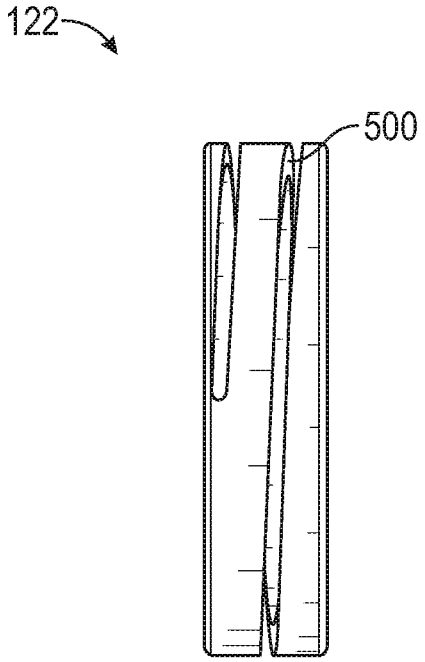

FIGS. 5A and 5B illustrate a perspective view and a side view, respectively, of yet another embodiment of the sealing ring 122. In this embodiment, the sealing ring 122 is helical. This helical shape may be formed by winding a material, e.g., as with a spring, or by cutting a slot helically into a tubular blank, e.g., entirely radially through the blank. In either such example, a helical gap 500 may be formed, which, in some embodiments, extends entirely through the radial dimension of the sealing ring 122. This embodiment may also serve to reduce the setting force required to expand the sealing ring 122, as compared to the embodiment of FIGS. 3A and 3B. In particular, as the tool 100 is set and the sealing ring 122 is driven up the tapered outer surface 130 of the cone 120, the sealing ring 122 partially unwinds, and thus expands by bending rather than by (or in addition to) forcing the thickness thereof to change.

Figure 6A:
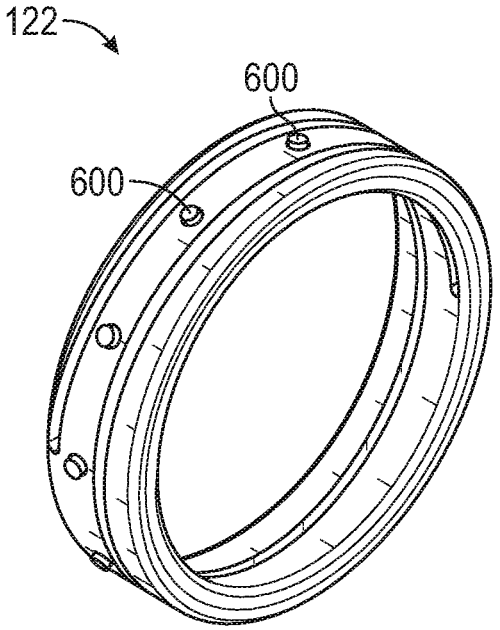
FIGS. 6A and 6B illustrate a perspective view and a side view, respectively, of another embodiment of the seal ring.
Figure 6B:
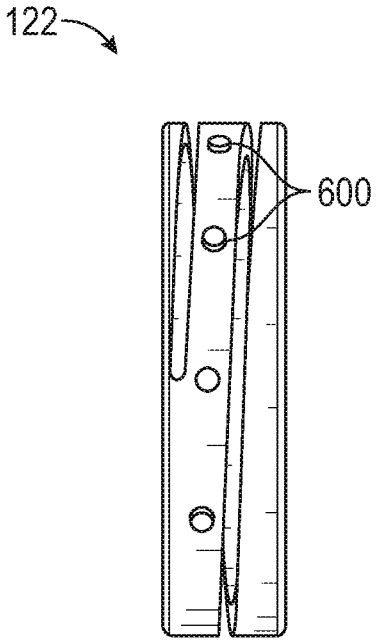

FIGS. 6A and 6B illustrate a side view and a perspective view, respectively, of still another embodiment of the sealing ring 122. In this embodiment, the sealing ring 122 is again helical, and operates to expand in generally the same way as the embodiment of FIGS. 5A and 5B. However, in this embodiment, the sealing ring 122 is additionally provided with inserts 600, which are sometimes referred to as "buttons." Such inserts 600 may be formed from material that is harder than the material of the sealing ring 122, e.g., carbide or ceramic. The inserts 600 may thus bite (e.g., partially embed) into the surrounding tubular when the tool 100 is set. The inserts 600 may be oriented to resist displacement of the sealing ring 122 toward the lower end of the mandrel 102 during flow-back operations. That is, the inserts 600 may resist the sealing ring 122 losing gripping force and being displaced from engagement with the surrounding tubular when the pressure differential across the tool 100 reverses (from high above, low below, to high below, low above). It will be appreciated that the inserts 600 may be added to any of the sealing ring 122 embodiments disclosed herein, and their addition to the helical embodiment is merely an example.

Figure 7:
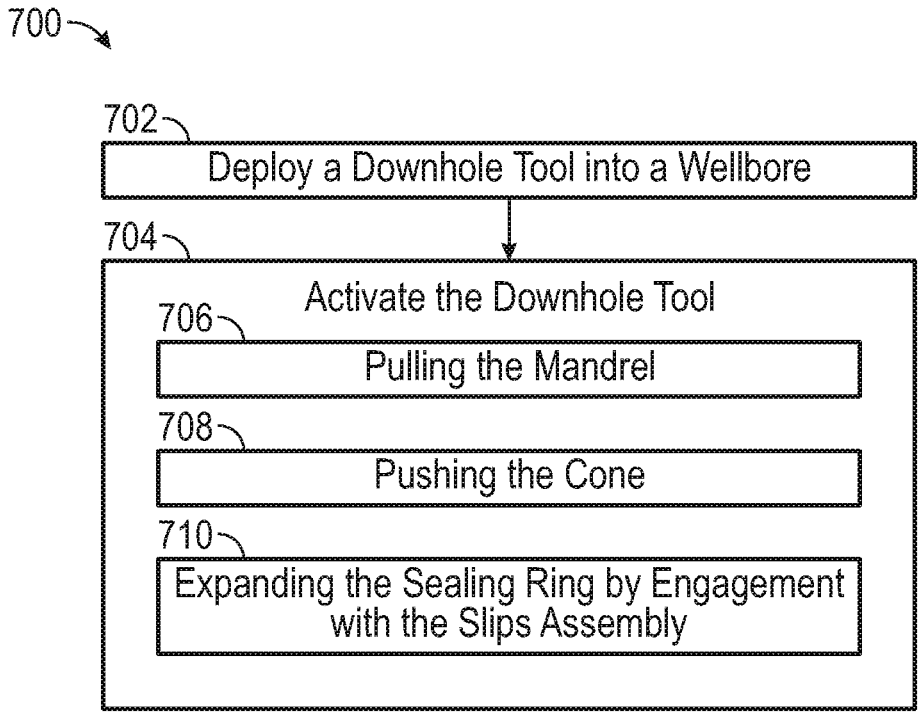
FIG. 7 illustrates a flowchart of a method for setting a downhole tool, according to an embodiment.

FIG. 7 illustrates a flowchart of a method 700 for plugging a wellbore, according to an embodiment. The method 700 may proceed by operation of an embodiment of the downhole tool 100, and is thus described herein, for convenience, with reference thereto. However, it will be appreciated that the method 700 may proceed by operation of other downhole tools, and is thus not to be considered limited to any particular structure unless otherwise specified herein.

The method 700 may include deploying a downhole tool 100 into a surrounding tubular (e.g., casing, liner, or the wellbore wall) of the wellbore, as at 702. At this point, the downhole tool 100 may be in a run-in configuration (e.g., as shown in FIG. 2A). As described above, the downhole tool 100 may include a mandrel 102 and a cone 120 having a tapered outer surface 130 and being received around the mandrel 102. The downhole tool 100 may also include a slip assembly 124 received around the mandrel 102 and positioned at least partially around the tapered outer surface 130 of the cone 120. The downhole tool 100 may further include a sealing ring 122 positioned around the tapered outer surface 130. The slip assembly 124 directly engages the sealing ring 122.

Once the downhole tool 100 is deployed to a desired depth in the wellbore, the method 700 may proceed to actuating the downhole tool 100 from the run-in configuration into a set configuration, as at 704. In an embodiment, actuating the downhole tool 100 may include pulling the mandrel 102 in an uphole direction, as at 706 and pushing the cone 120 in a downhole direction, as at 706. Pulling the mandrel 102 and pushing the cone 120 causes the slip assembly 124 to move the sealing ring 122 along the tapered outer surface 130 of the cone 120, thereby expanding the sealing ring 122 radially outward and into engagement with the surrounding tubular, as at 710.

In an embodiment, pulling the mandrel 102 and pushing the cone 120 causes the slip assembly 124 to expand radially outwards. Furthermore, actuating the downhole tool 100 from the run-in configuration into the set configuration causes the sealing ring 122 to form a metal-to-metal seal with the surrounding tubular. In some embodiments, the downhole tool 100 lacks a rubber sealing element that engages the surrounding tubular.

The sealing ring 122 may also include an outer surface 300 which may have a constant diameter. In such an embodiment, expanding the sealing ring 122 includes reducing a radial thickness of the sealing ring (e.g., the inner and outer diameters of the ring 122 may be increased, but the inner diameter may be increased more than the outer diameter).

In another embodiment, the outer surface 300 of the sealing ring 122 has two axially-separated peaks 404, 406 and a recessed section 402 between the two peaks 404, 406. In such an embodiment, expanding the sealing ring 122 may include deforming the two peaks 404, 406 as they engage the surrounding tubular.

In another embodiment, the sealing ring 122 is helical (either wound or with a helical cut or gap 500 formed therein). In such an embodiment, expanding the sealing ring 122 causes the sealing ring 122 to at least partially unwind.

In various embodiments, the sealing ring 122 may include a plurality of inserts 600. As such, expanding the sealing ring 122 may cause the plurality of inserts 600 to bite into the surrounding tubular.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a cone having a tapered outer surface;

a slip assembly positioned at least partially around the tapered outer surface of the cone; and a sealing ring positioned at least partially around the tapered outer surface of the cone, wherein the slip assembly directly engages the sealing ring, such that the slip assembly is configured to transmit a setting force directly onto the sealing ring, which moves the sealing ring on the tapered outer surface of the cone and expands the sealing ring radially outward, wherein the sealing ring comprises a first annular peak and a second annular peak that are axially offset from one another, and wherein the sealing ring comprises a recessed section that extends between and connects together the first and second annular peaks, the recessed section being oriented at a non-zero angle with respect to a central longitudinal axis of the sealing ring such that the recessed section intersects the first peak farther radially outward than where the recessed section intersects the second peak.

2. The downhole tool of claim 1, wherein the sealing ring is metal.

3. The downhole tool of claim 2, wherein the metal comprises magnesium.

4. The downhole tool of claim 1, wherein the sealing ring is configured to form a metal-to-metal seal with a surrounding tubular in which the downhole tool is deployed, and wherein the downhole tool lacks a rubber sealing element that engages the surrounding tubular.

5. The downhole tool of claim 1, wherein the sealing ring is at least partially helical.

6. The downhole tool of claim 1, wherein the sealing ring comprises a helical gap.

7. The downhole tool of claim 1, wherein the sealing ring comprises a plurality of inserts configured to bite into a surrounding tubular in which the downhole tool is deployed when the sealing ring is expanded, such that the inserts are configured to embed at least partially into the surrounding tubular.

8. The downhole tool of claim 1, further comprising a mandrel, wherein the cone, the slip assembly, and the sealing ring are positioned around the mandrel.

9. A method of plugging a wellbore, comprising:

deploying a downhole tool into a surrounding tubular of the wellbore, the downhole tool being in a run-in configuration, wherein the downhole tool comprises:

a mandrel;

a cone having a tapered outer surface, the cone being received around the mandrel;

a slip assembly received around the mandrel and positioned at least partially around the tapered outer surface of the cone; and a sealing ring positioned at least partially around the tapered outer surface, wherein the slip assembly directly engages the sealing ring, wherein the sealing ring comprises a first annular peak and a second annular peak that are axially offset from one another, and wherein the sealing ring comprises a recessed section that extends between and connects together the first and second annular peaks, the recessed section being oriented at a non-zero angle with respect to a central longitudinal axis of the sealing ring such that the recessed section intersects the first peak farther radially outward than where the recessed section intersects the second peak; and actuating the downhole tool from the run-in configuration into a set configuration, wherein actuating the downhole tool comprises:

pulling the mandrel in an uphole direction; and pushing the cone in a downhole direction, wherein pulling the mandrel and pushing the cone causes the slip assembly to move the sealing ring along the tapered outer surface, thereby expanding the sealing ring radially outward and into engagement with the surrounding tubular.

10. The method of claim 9, wherein pulling the mandrel and pushing the cone causes the slip assembly to expand radially outwards.

11. The method of claim 9, wherein the sealing ring comprises magnesium.

12. The method of claim 9, wherein actuating the downhole tool from the run-in configuration into the set configuration causes the sealing ring to form a metal-to-metal seal with the surrounding tubular.

13. The method of claim 12, wherein the downhole tool lacks a rubber sealing element that engages the surrounding tubular.

14. The method of claim 9, wherein the sealing ring is helical, and wherein expanding the sealing ring causes the sealing ring to at least partially unwind.

15. The method of claim 9, wherein the sealing ring comprises a plurality of inserts, wherein expanding the sealing ring causes the plurality of inserts to bite into the surrounding tubular such that the plurality of inserts are at least partially embedded in the surrounding tubular.

16. A downhole tool, comprising:

a mandrel;

a cone having a tapered outer surface and received around the mandrel;

a mule shoe coupled to the mandrel;

a slips assembly positioned at least partially between the mule shoe and the cone;

a sealing ring positioned at least partially around the tapered outer surface of the cone and made of metal, wherein an axial surface of the sealing ring is in direct engagement with an axial surface of the slips assembly, such that, pulling the mandrel and pushing the cone causes the mule shoe to move the slips assembly toward the sealing ring, which causes the sealing ring to move along the tapered outer surface of the cone and expand radially outward into engagement with a surrounding tubular; and inserts positioned in the sealing ring, made from a material that is harder than the sealing ring, and configured to bite into in the surrounding tubular, such that the inserts at least partially embed into the surrounding tubular, wherein the sealing ring comprises a first peak and a second peak that are axially offset from one another and extend at least partially around the sealing ring, and wherein the sealing ring comprises a recessed section that extends between and connects together the first and second peaks, the recessed section being oriented at a non-zero angle with respect to a central longitudinal axis of the sealing ring such that the recessed section intersects the first peak farther radially outward than where the recessed section intersects the second peak.

17. The tool of claim 16, wherein the first and second peaks are both annular.

* * * * *